US006318028B2

(12) United States Patent
Alley

(10) Patent No.: US 6,318,028 B2
(45) **Date of Patent: *Nov. 20, 2001**

(54) SNOW GUARD SYSTEM HAVING MOUNTING BLOCK AND CLAMPING PAD FOR SECURING TO A ROOF SEAM

(76) Inventor: F. William Alley, Gebbie Rd., Greensboro, VT (US) 05841

( * ) Notice: Subject to any disclaimer, the term of this patent is extended or adjusted under 35 U.S.C. 154(b) by 0 days.

This patent is subject to a terminal disclaimer.

(21) Appl. No.: 09/757,203

(22) Filed: Jan. 9, 2001

Related U.S. Application Data

(63) Continuation of application No. 09/340,501, filed on Jun. 30, 1999.

(51) Int. Cl.[7] ..... E04D 13/10
(52) U.S. Cl. ..... 52/25; 52/24; 52/26; 411/432
(58) Field of Search ..... 52/25, 24, 26; 411/432, 9.7

(56) References Cited

U.S. PATENT DOCUMENTS 5,613,328 3/1997 Alley .
5,732,513 3/1998 Alley .

*Primary Examiner*—Carl D. Friedman
*Assistant Examiner*—Dennis L. Dorsey
(74) *Attorney, Agent, or Firm*—Burr & Brown

(57) ABSTRACT

A mounting assembly is provided for puncture-free attachment of a snow guard system to a roof seam. The assembly comprises a mounting block, at least one clamping member, and an actuation member. Once actuated, the clamping member prevents relative movement between the mounting block and the seam. At least one clamping member positioned adjacent a groove located in the base of the mounting block. The clamping member includes a first side having at least one primary contact surface outwardly protruding a first distance from the first side. The clamping member also includes at least one secondary contact surface protruding a second distance from the first side. In the preferred embodiment, the second distance is less than the first distance thereby making the primary contact surface(s) the first to engage the seam upon actuation of the member. Preferably, the clamping member includes a second side having at least one protrusion for engagement with a first end of the actuation member. Prior to actuation of the clamping member, this second side is initially received within the groove. When actuated the actuation member moves the clamping member toward the seam to cause at least the primary contact surface to engage the seam, thereby preventing relative movement between the mounting block and the seam. According to the second embodiment a plurality of clamping members are utilized. These clamping members are preferably located on opposite sides of the groove and more preferably offset from one another such that the respective contact surfaces of each member alternately engage the seam.

13 Claims, 15 Drawing Sheets

SNOW GUARD SYSTEM HAVING MOUNTING BLOCK AND CLAMPING PAD FOR SECURING TO A ROOF SEAM

CROSS REFERENCE TO RELATED APPLICATION

This is a continuation application of U.S. Ser. No. 09/340,501, filed Jun. 30, 1999, now allowed, the entirety of which is incorporated herein by reference.

BACKGROUND OF THE INVENTION

1. Field of the Invention

The present invention relates generally to a snow guard system capable of being attached to a roof, which is used to prevent snow from sliding off the roof, and more particularly to an improved clamping means for securing such snow guard systems to a roof seam.

2. Related Art

Sliding snow and/or ice from roofs can be hazardous to people, the surrounding landscape, property, and building components. The problem of sliding snow or ice is particularly prevalent in connection with raised seam metal roofs, where there is relatively little friction between the roof and the snow or ice.

As shown in FIG. 1, conventional snow guard systems 200 have long been used for controlling movement of snow and ice across selected areas of roofs by preventing sliding of snow and ice down the pitch of the roof. Recently, these snow guard systems have increased in popularity, and currently several snow guard mounting systems serve to hold snowloads on roofs. For example, one such snow guard system is discussed in Applicants pending application Ser. No. 09/280,635, entitled "SNOW GUARD SYSTEM HAVING A FLAG TYPE ATTACHMENT," which is incorporated herein by reference in its entirety.

Since the advent of snow guard systems, inventors have adopted a number of means for securing the snow guards to a roof. For example, see U.S. Pat. No. 3,880,405. With the advent of raised seam metal roofs, it has become particularly problematic to attach conventional snow guards thereto. A typical metal roof comprises a plurality of metal roofing panels that are laid side by side to cover the width of a roof section. Each panel usually includes substantially perpendicular edges running along both the left and right sides thereof. The roofing panels are located such that their substantially perpendicular edges arc abutting, thereby forming a seam therebetween. The substantially perpendicular edges of the abutting panels are each typically crimped together and/or bent downwardly over each other to form a joint. The joint seals the adjoining panels, thereby preventing fluid communication to the roofing substructure below the roofing panels, as well as to the area between each roofing panel. Various metal roof installers have devised unique patterns for the joints, and as a result a wide variety of joints exist.

As shown in FIG. 1B, in snow guard assemblies used on seamed metal roofs, the assembly is typically attached to the roof seam using a mounting block 18 secured by an attachment means. For instance, one possible attachment method is via screws or bolts. However, both screws and bolts require puncturing the roofing seam 12 to hold the assembly in place. Once the snow guard assembly is removed, any holes created by the screws or bolts remain, thereby destroying the hermeticity of the metal roof. Moreover, such holes allow water to contact the roof substructure even while the snowguard is still attached.

To solve this problem, the Applicant had previously developed an attachment device capable of being attached to a metal roof without tearing, puncturing or otherwise destroying the hermeticity of the metal roof seam 12. This attachment device is described in detail in Applicant's U.S. Pat. No. 5,613,328, the entirety of which is incorporated herein by reference.

According to the teachings of this patent, as shown in FIGS. 2A and 2B, a device was provided capable of being attached to a metal roof seam 12. This device includes a mounting block 18 having a first side wall 52 and a second side wall 54, a base 53 and a top 51. A groove 24 located in the base 53 of the block 18 allows the block 18 to be located on the metal roof by placement of the groove 24 about a segment of the seam 12. A first threaded hole 62 is located in the block between the first side wall 52 and the groove 24. In order to attach the mounting block 18 to the seam 12, a ball 100 and first set screw 102 is provided. The ball 100 has a substantially curved surface 101. A first set screw 102 is translocatable within the first threaded hole 62. This first set screw 102 has a first terminal end 104 juxtaposed with the ball 100 such that the curved surface 101 of the attached mechanism 100 and 102 is diametrical thereto and is pivotable thereabout. As shown in FIG. 2A, the first set screw 102 further has a second terminal end 106 drivable into the first threaded hole 62. As shown in FIG. 2B, driving the first set screw 102 into the first threaded hole 62 would cause the substantially curved surface 101 of the ball 100 to engage a first portion 105 of the seam 12 of the metal roof. Consequently, rotational movement of the curved surface 101 of the ball 100 is precluded relative to the first portion 105 of the seam 12 as the ball engages the seam 12. As a result, the first set screw 102 pivots about the curved surface 101 of the ball 100. Moreover, further driving of the first set screw 102 causes the first engaged portion 105 of the seam 12 to be driven towards the portion of groove 24 diametric thereto, thereby forming a pocket in the first engaged portion 105 of the seam 12. As a result, the mounting block 18 could be secured to the roof without piercing or tearing the seam 12.

Although this method of attachment represented a vast improvement over the prior attachment methods, there is still room for improvement.

For example, in the ball and screw arrangement, the entire holding force per attachment mechanism is limited to the force which can be applied through an individual contact surface. That is, the contact area between the seam 12 and each ball 100 is limited to only a singular, independent contact surface 101. Because such a design requires that the entire contact force be applied through a single contact surface 101 on each ball 100, the total amount of static holding force (which is equal to the summation of the holding forces of each individual contact surface), is determined by the number of balls engaging the roof seam 12. Since the holding force per attachment mechanism is limited to (the force transmitted through) the singular contact surface 101, the net holding force available for holding the mounting block in place is significantly limited.

Moreover, providing only a single contact surface results in a relatively unstable connection since sliding will occur if the force of the snow load exceeds the friction of force at that singular point of contact. Thus, if too few attachment mechanisms (i.e., ball 100 and set screw 102) are employed, the mounting block will be susceptible to separating from the seam under heavier snow loads and sliding along the seam when the force of the snowload exceeds the friction of force between the contact surface and the seam.

Thus, it would be desirable to apply a greater amount of pressure to the seam per attachment mechanism thereby eliminating the need to employ an excessive number of attachment mechanisms. It would also be desirable to distribute the contact load through a greater number of points over the length of the seam to prevent sliding. Accordingly, a need exists for an attachment mechanism that will decrease the amount of holding force applied through each contact surface, while maintaining enough pressure per attachment mechanism to hold the mounting block 18 in place when particularly heavy snowloads are applied.

SUMMARY OF THE INVENTION

It is an object of the present invention to improve upon the prior art snow guard systems desired above.

These objects are achieved by replacing the ball with a clamping pad having multiple contact surfaces. This clamping pad is advantageous in that each contact area serves to deform a roof seam thereby increasing the effective contact area between the roof seam and clamping pad. By increasing the effective contact area between the roof seam and the clamping pad the sliding resistance of the clamping pad along the seam is significantly increased. Preferably, the deformation of the roof seam is significant enough to actually cause a mechanical distortion in the linearity of the roof seam.

The use of multiple contact surfaces is also advantageous since it allows the holding force to be distributed more evenly over a greater area of the seam (and over a greater number of contact points). By distributing the contact surfaces in this manner, a greater net holding force can be applied without violating or otherwise destroying the integrity of the surface finish or the seam itself (i.e., crack the surface). That is, when multiple contact surfaces are employed the maximum holding force that can be applied through each individual contact surface (without cracking the surface) does not change, and the net holding force which can be applied by each clamping pad is equal to the sum of the holding forces that can be applied through each individual contact surface. Thus, by distributing the contact surfaces in this manner, it is possible to apply a greater net holding force to the seam per attachment mechanism.

Using multiple contact surfaces also provides improved stability of the connection, since utilizing a plurality of contact surfaces provides increased sliding resistance between the seam and the clamping pad. This is because the snowload must simultaneously exceed the friction force between the seam and each of the contact surfaces to detach the clamping pad from the seam. Thus, the holding force is more stable.

To carry out the objects described above, one embodiment of the present invention is directed to a mounting assembly for puncture-free attachment of a snow guard system to a roof seam. The assembly comprises a mounting block, at least one clamping pad, and an actuation member. Once actuated, the clamping pad prevents relative movement between the mounting block and the seam.

The mounting block has a groove formed therein for receiving the seam. In a preferred embodiment, the mounting block comprises a top surface, a bottom surface, a first sidewall and a second sidewall. The groove is preferably located in the bottom surface of the block, defined by a pair of parallel walls. In the preferred embodiment, each wall has at least one notched region formed along at least a portion of its length. The mounting block preferably includes at least one bore extending through the mounting block between the first sidewall and into the notched region. Each bore receives the actuation member which is drivable into the bore. The actuation member will be described in detail below.

At least one clamping pad is positioned adjacent the groove. The clamping pad includes a first side having at least one primary contact surface outwardly protruding a first distance from the first side. The clamping pad further includes at least one secondary non-spherical contact surface protruding a second distance from the first side. Preferably, the clamping pad also includes a second side having at least one protrusion for engagement with a first end of the actuation member. Prior to actuation of the clamping pad, this second side is initially received within the first notched region of the groove.

When actuated the actuation member moves the clamping pad toward the seam to cause at least the primary contact surface to engage the seam. This prevents relative movement between the mounting block and the seam. That is, by driving the actuation member into the bore, the first end engages the protrusion thereby causing at least a portion of the first side to engage a portion of the seam. The primary contact surface should preferably cause the roof seam to dimple, and for maximum holding power should cause a mechanical distortion to the linearity of the roof seam. The secondary contact surface may also be brought into contact with the seam when greater holding power is desired.

Additional objects, advantages, and other novel features of the invention will become apparent to those skilled in the art upon examination of the detailed description and drawings that follow.

DETAILED DESCRIPTION OF THE INVENTION

In order that the present invention may be more readily understood, the following description is given, merely by way of example, reference being made to the accompanying drawings.

Figure 1A:
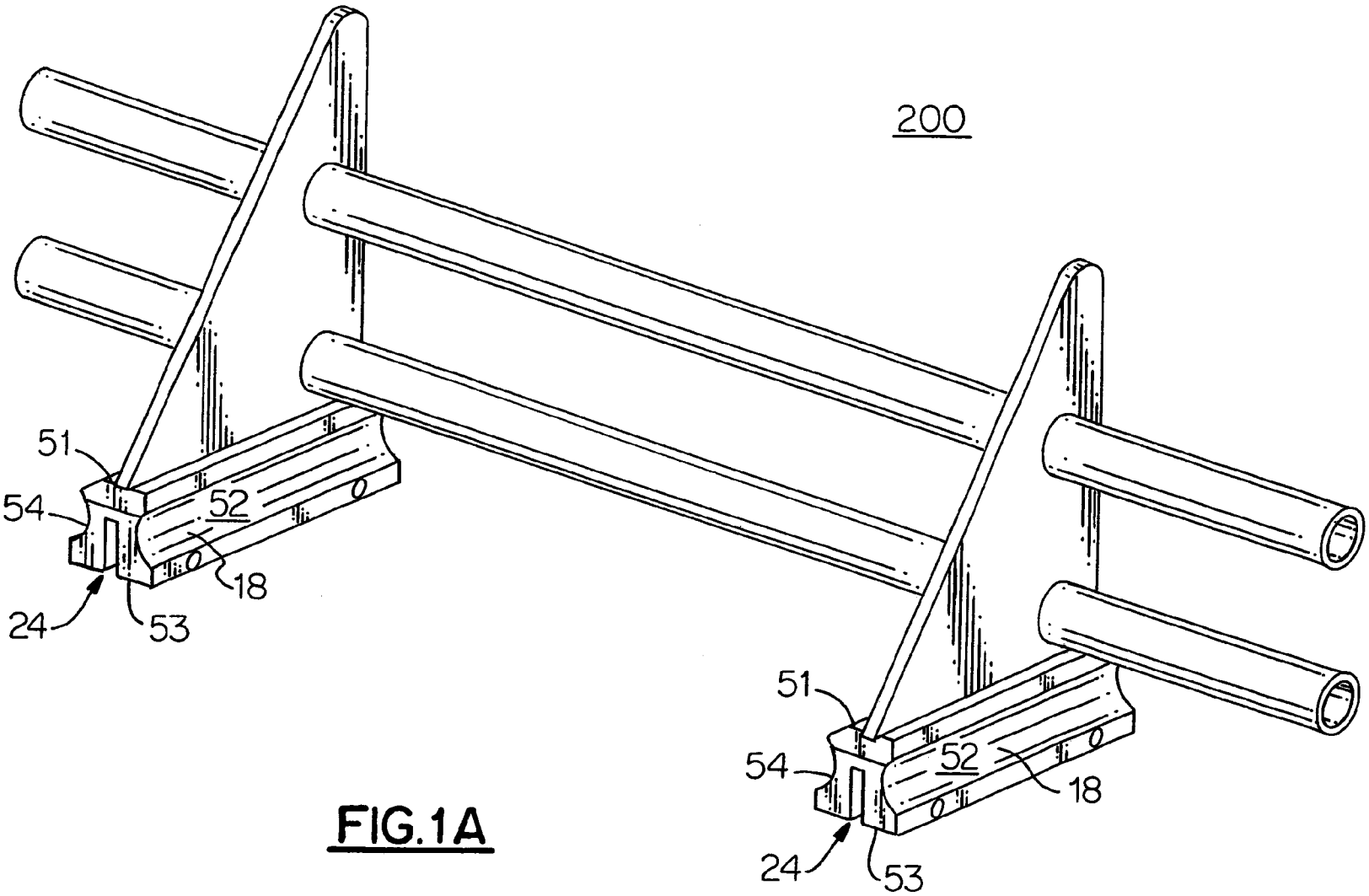
FIG.1A PRIOR ART
FIG. 1A shows a prior art snow guard system for attachment to a seamed metal roof.
Figure 1B:
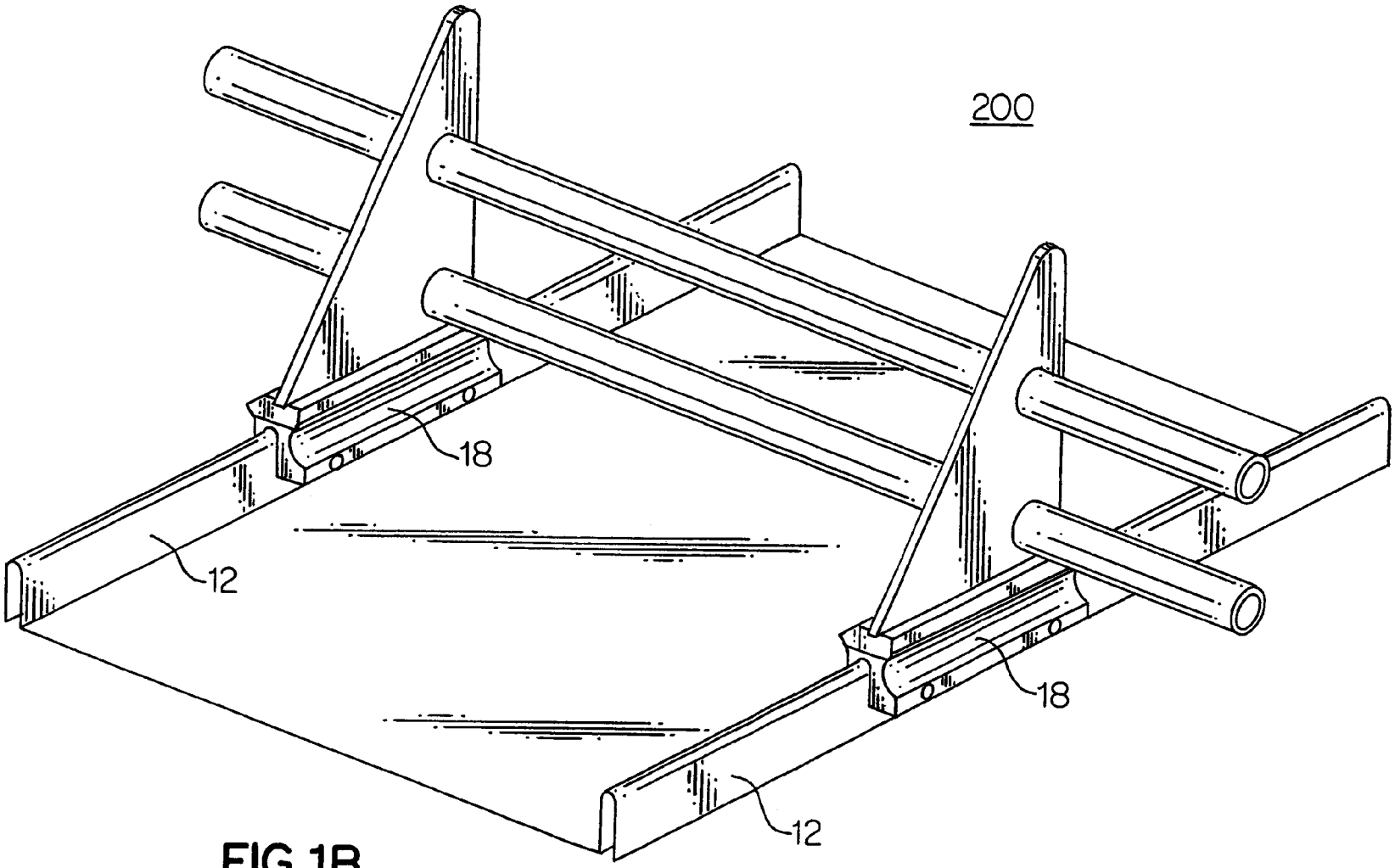
FIG.1B PRIOR ART
FIG. 1B shows a prior art snow guard system attached to a seamed metal roof.
Figure 2A:
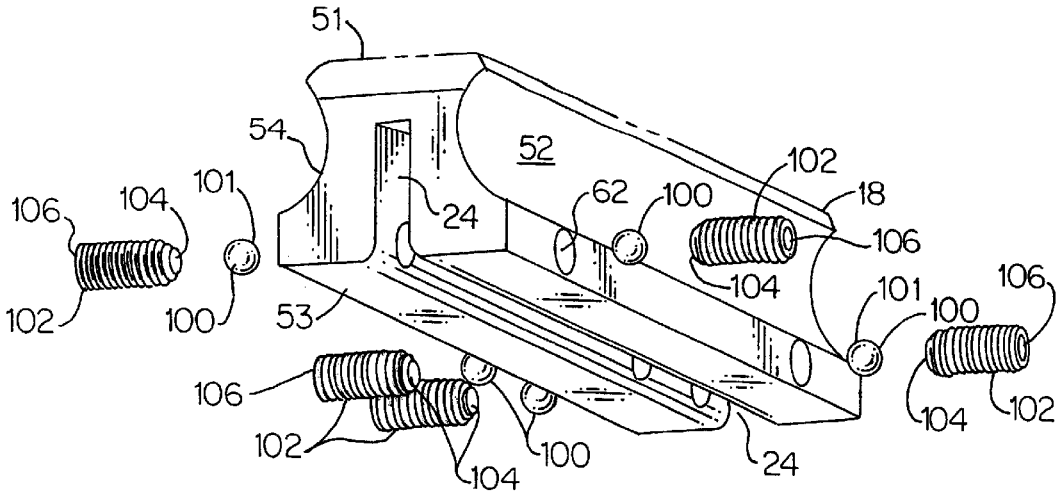
FIG. 2A PRIOR ART
FIG. 2A shows a prior art snow guard attachment mechanism prior to attachment to a roof seam.
Figure 2B:
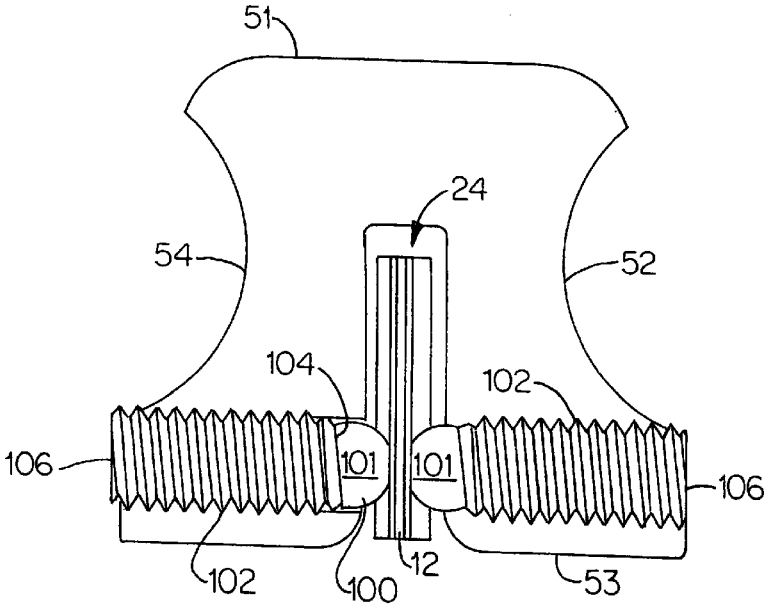
FIG. 2B PRIOR ART
FIG. 2B shows the prior art snow guard attachment mechanism placed on a roof seam with the attachment mechanism engaging the seam.
Figure 2C:
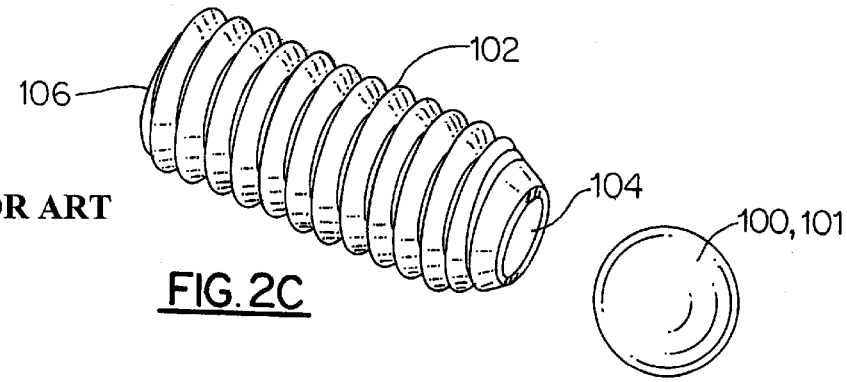
PRIOR ART FIG. 2C
FIG. 2C shows an individual attachment mechanism.
Figure 3A:
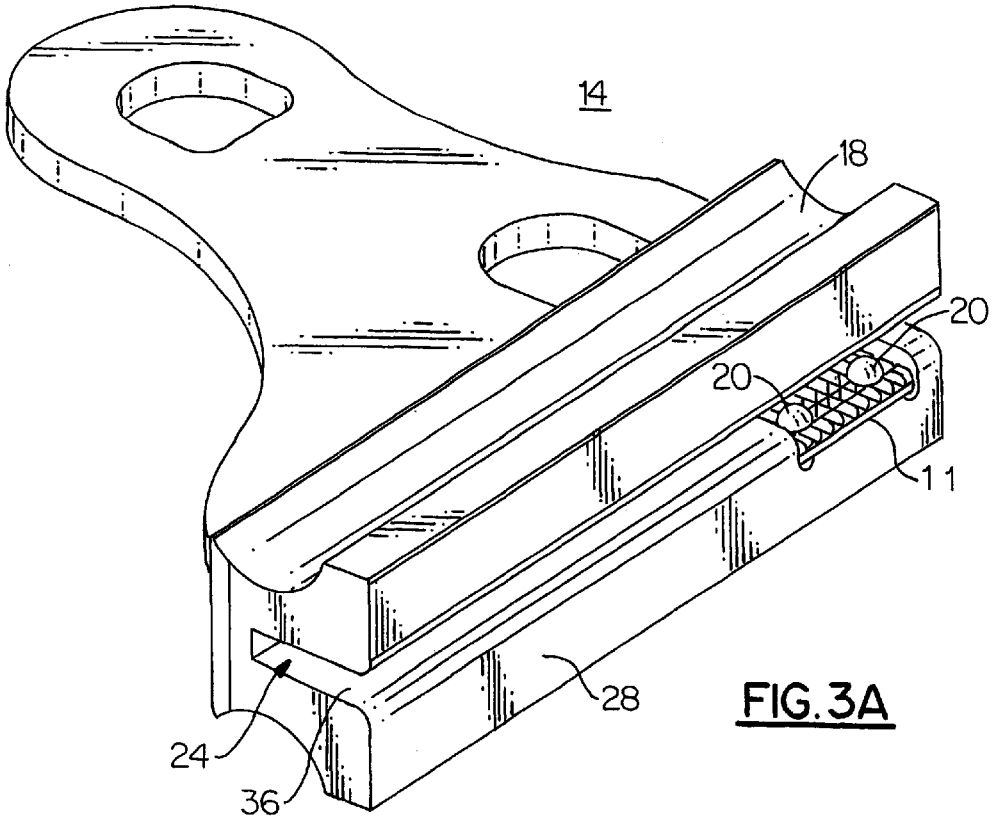
FIG. 3A shows a perspective view of the mounting assembly of the present invention utilizing a singular clamping pad to engage the seam.
Figure 3B:
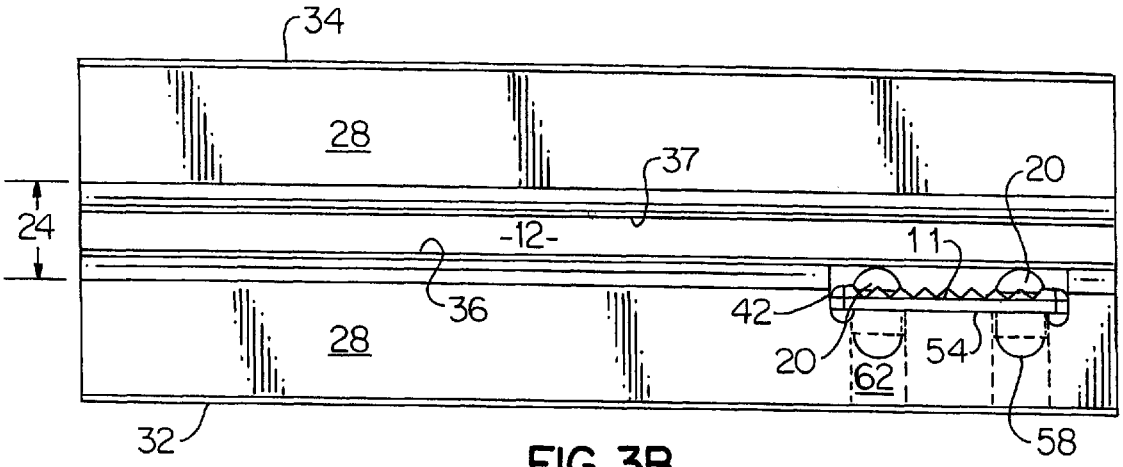
FIG. 3B shows a bottom view of the mounting assembly shown in FIG. 3A.
Figure 4A:
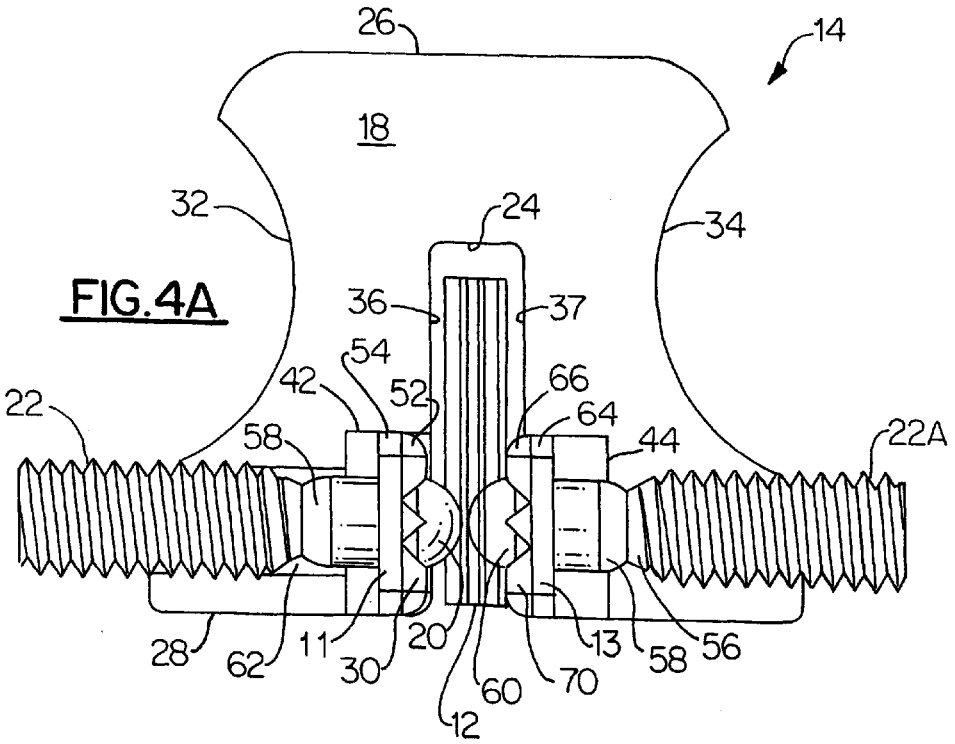
FIG. 4A shows a front view of the mounting assembly shown in FIG. 3 with actuation members engaging their respective clamping pads to contact the roof seam.
Figure 4B:
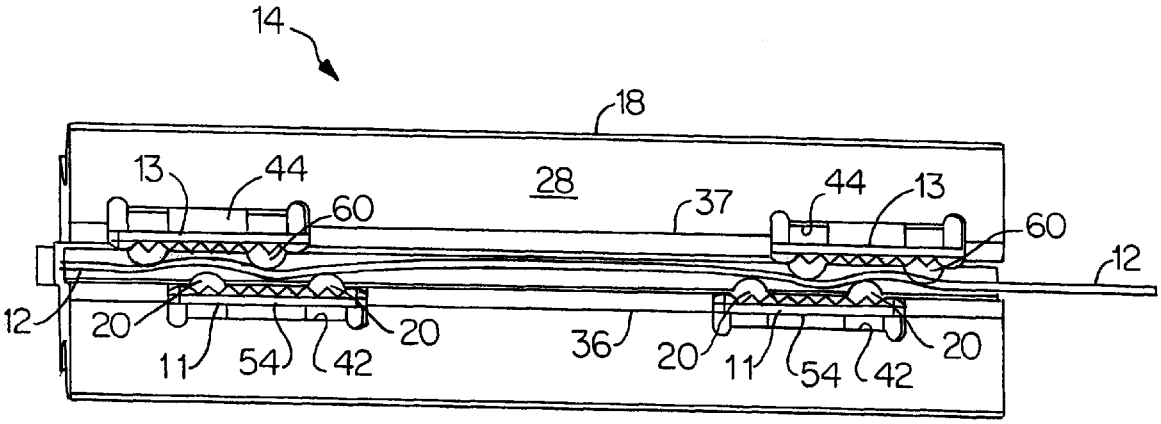
FIG. 4B shows a bottom view of the mounting assembly shown in FIG. 4A after the actuation member has engaged the clamping pad and forced the clamping pad into the seam.
Figure 5:
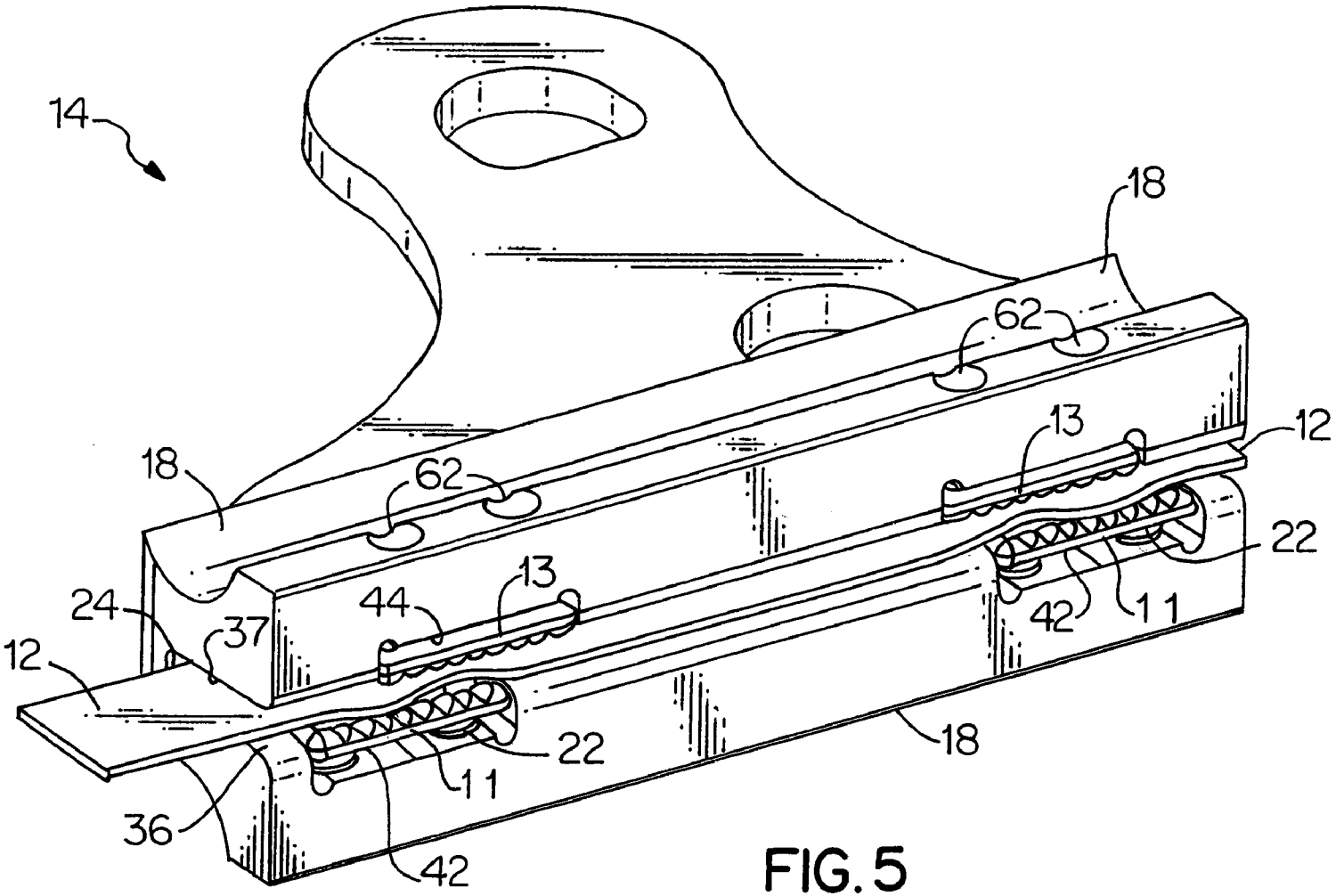
FIG. 5 shows a perspective view of the attachment mechanism according to the present invention.
Figure 6A:
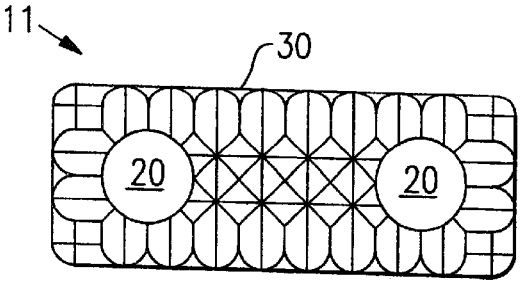
FIGS. 6A through 6D show a top view, perspective view, side view and end view, respectively, of a first embodiment of the clamping pad.
Figure 6B:
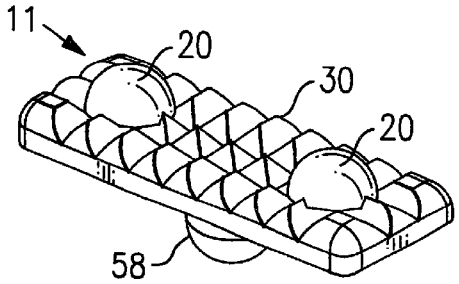
Figure 6C:
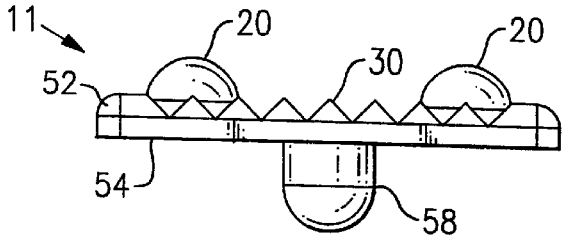
Figure 6D:
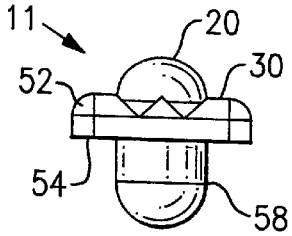
Figure 7A:
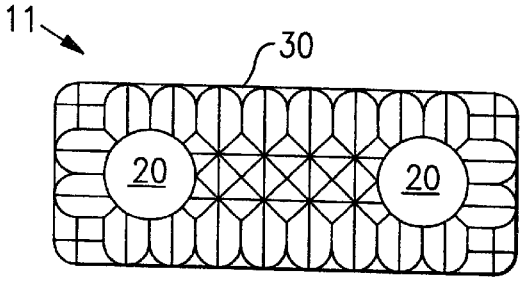
FIGS. 7A through 7D show a top view, perspective view, side view and end view, respectively, of a second embodiment of the clamping pad.
Figure 7B:
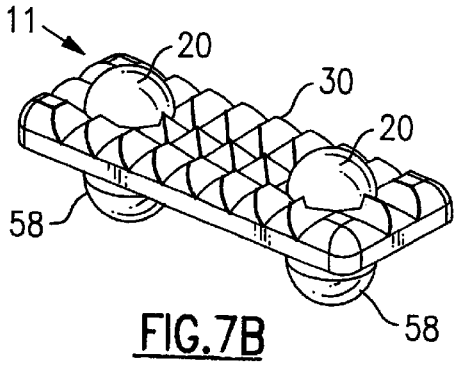
Figure 7C:
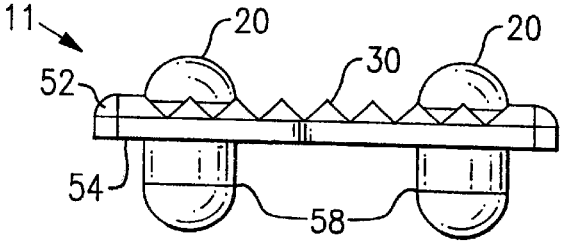
Figure 7D:
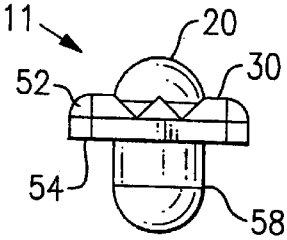
Figure 8A:
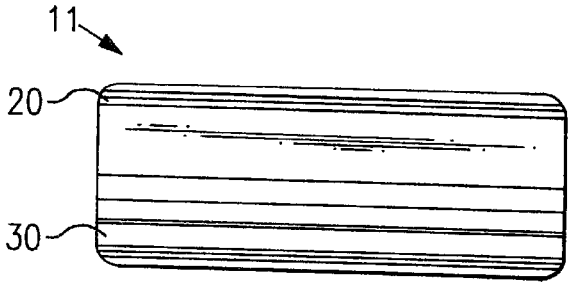
FIGS. 8A through 8D show a top view, perspective view, side view and end view, respectively, of a third embodiment of the clamping pad.
Figure 8B:
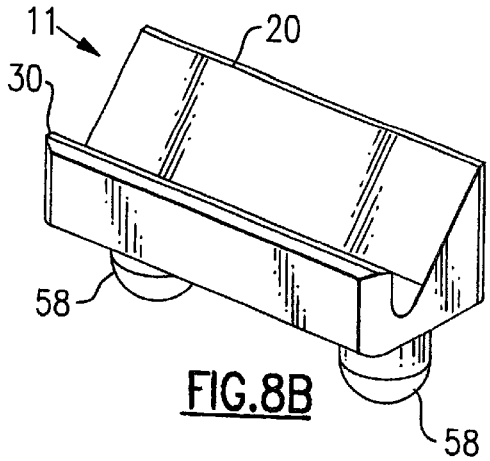
Figure 8C:
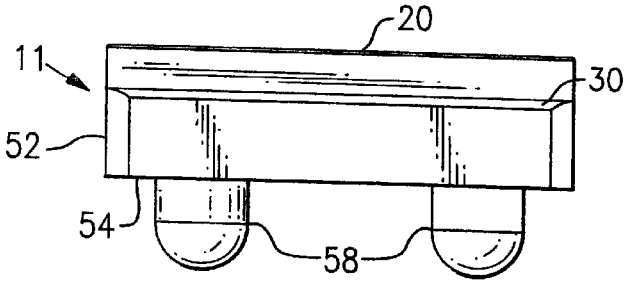
Figure 8D:
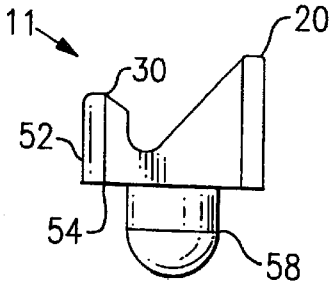
Figure 9A:
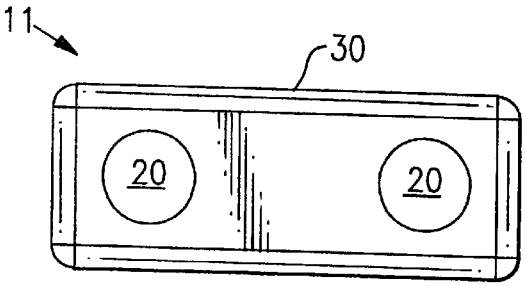
FIGS. 9A through 9D show a top view, perspective view, side view and end view, respectively, of a fourth embodiment of the clamping pad.
Figure 9B:
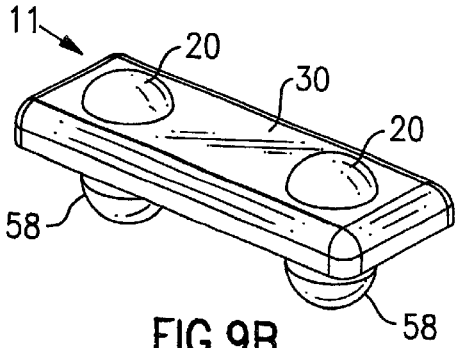
Figure 9C:
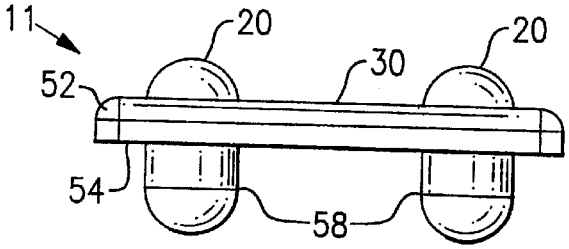
Figure 9D:
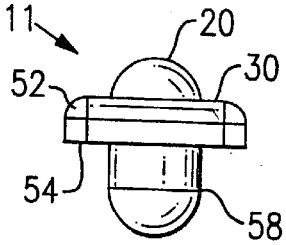
Figure 10A:
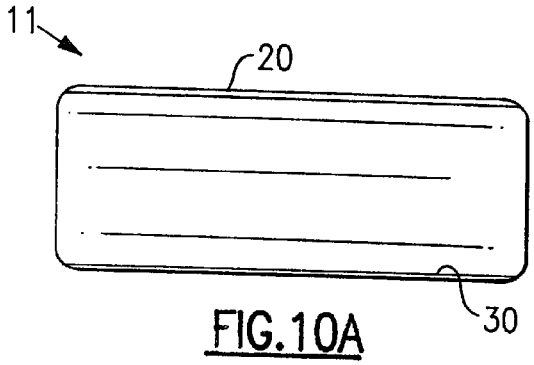
FIGS. 10A through 10D show a top view, perspective view, side view and end view, respectively, of a fifth embodiment of the clamping pad.
Figure 10B:
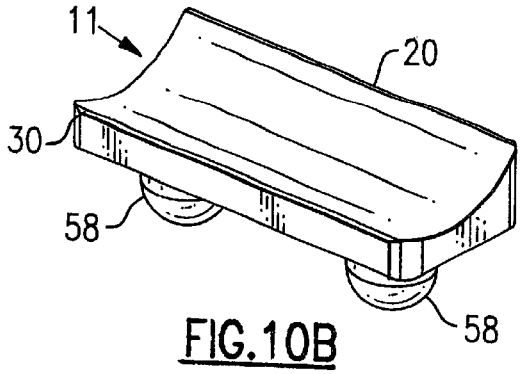
Figure 10C:
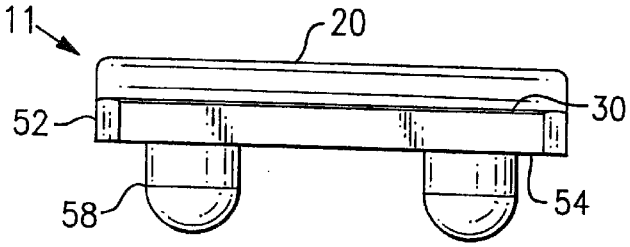
Figure 10D:
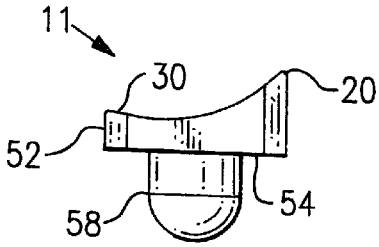
Figure 11A:
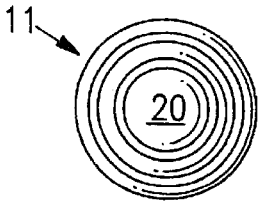
FIGS. 11A through 11D show a top view, perspective view, side view and end view, respectively, of a sixth embodiment of the clamping pad.
Figure 11B:
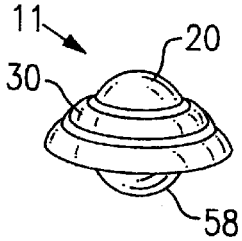
Figure 11C:
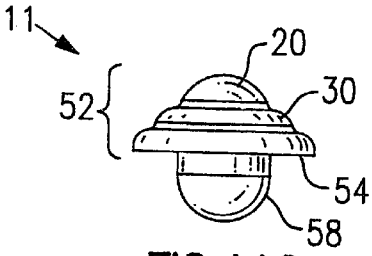
Figure 11D:
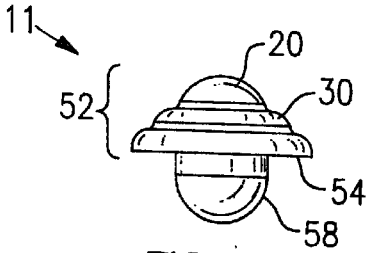
Figure 12A:
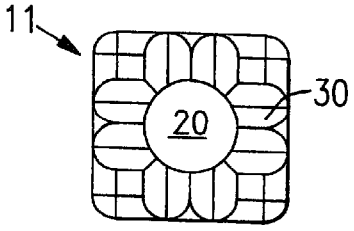
FIGS. 12A through 12D show a top view, perspective view, side view and end view, respectively, of a seventh embodiment of the clamping pad.
Figure 12B:
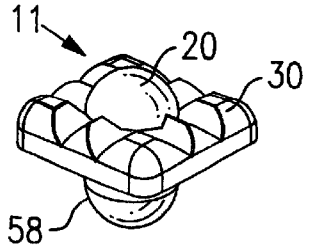
Figure 12C:
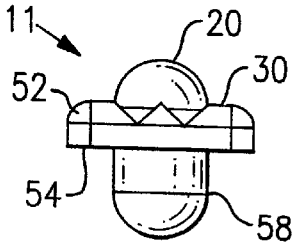
Figure 12D:
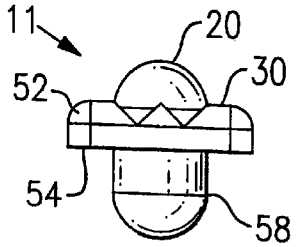
Figure 13A:
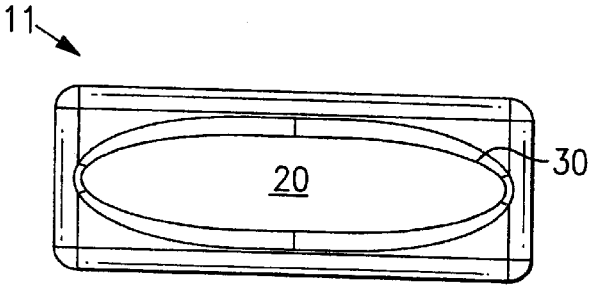
FIGS. 13A through 13D show a top view, perspective view, side view and end view, respectively, of an eighth embodiment of the clamping pad.
Figure 13B:
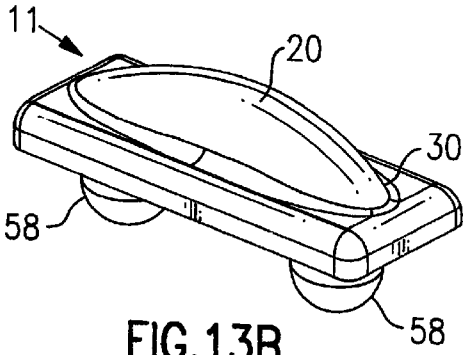
Figure 13C:
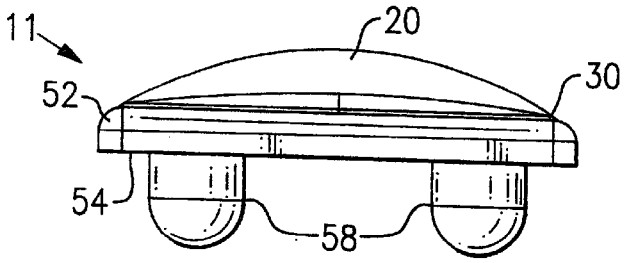
Figure 13D:
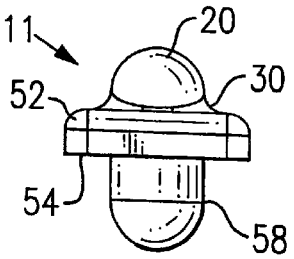
Figure 14A:
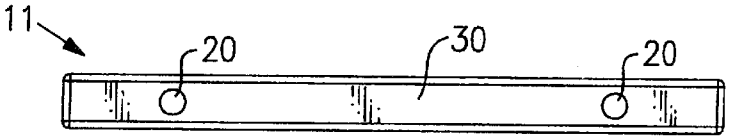
FIGS. 14A through 14D show a top view, perspective view, side view and end view, respectively, of a ninth embodiment of the clamping pad.
Figure 14B:
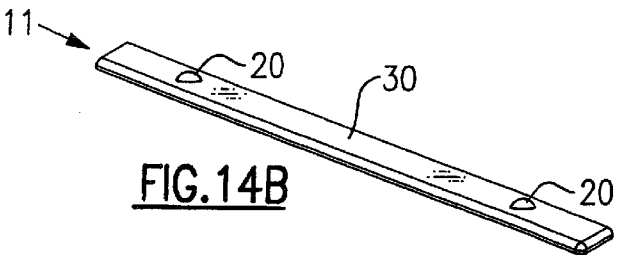
Figure 14C:
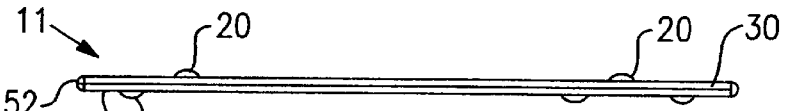
Figure 14D:
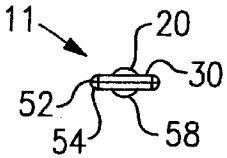
Figure 15A:
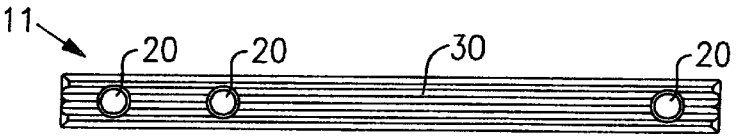
FIGS. 15A through 15D show a top view, perspective view, side view and end view, respectively, of a tenth embodiment of the clamping pad.
Figure 15B:
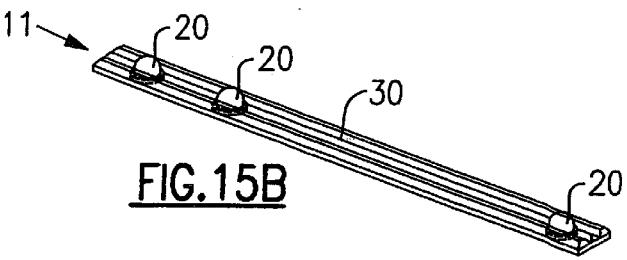
Figure 15C:
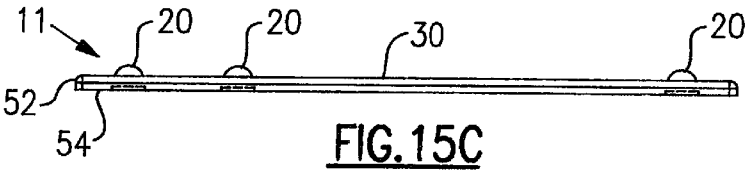
Figure 15D:
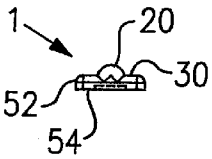
Figure 16B:
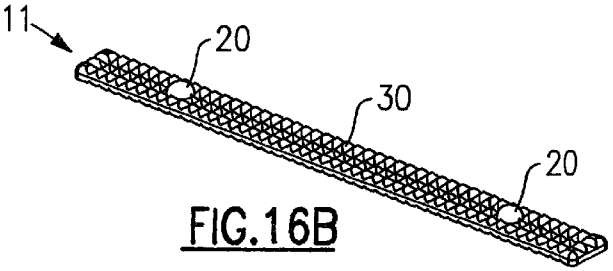
FIGS. 16A through 16D show a top view, perspective view, side view and end view, respectively, of an eleventh embodiment of the clamping pad.
Figure 16D:
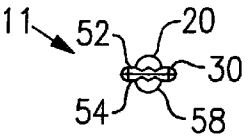

To carry out the objects described above, one embodiment of the present invention is directed to a mounting assembly 14 for puncture-free attachment of a snow guard system to a roof seam 12. As shown in FIGS. 3A, 3B, the assembly comprises a mounting block 18, at least one clamping pad 11, and an actuation member 22 (not shown). In the preferred embodiment, shown in FIG. 3C, a plurality of clamping pads are provided. The preferred embodiment will be described below. FIGS. 4A, 4B and 5 illustrate that once actuated, each clamping pad 11 engages the seam to prevent relative movement between the mounting block 18 and the seam 12.

Figure 3C:
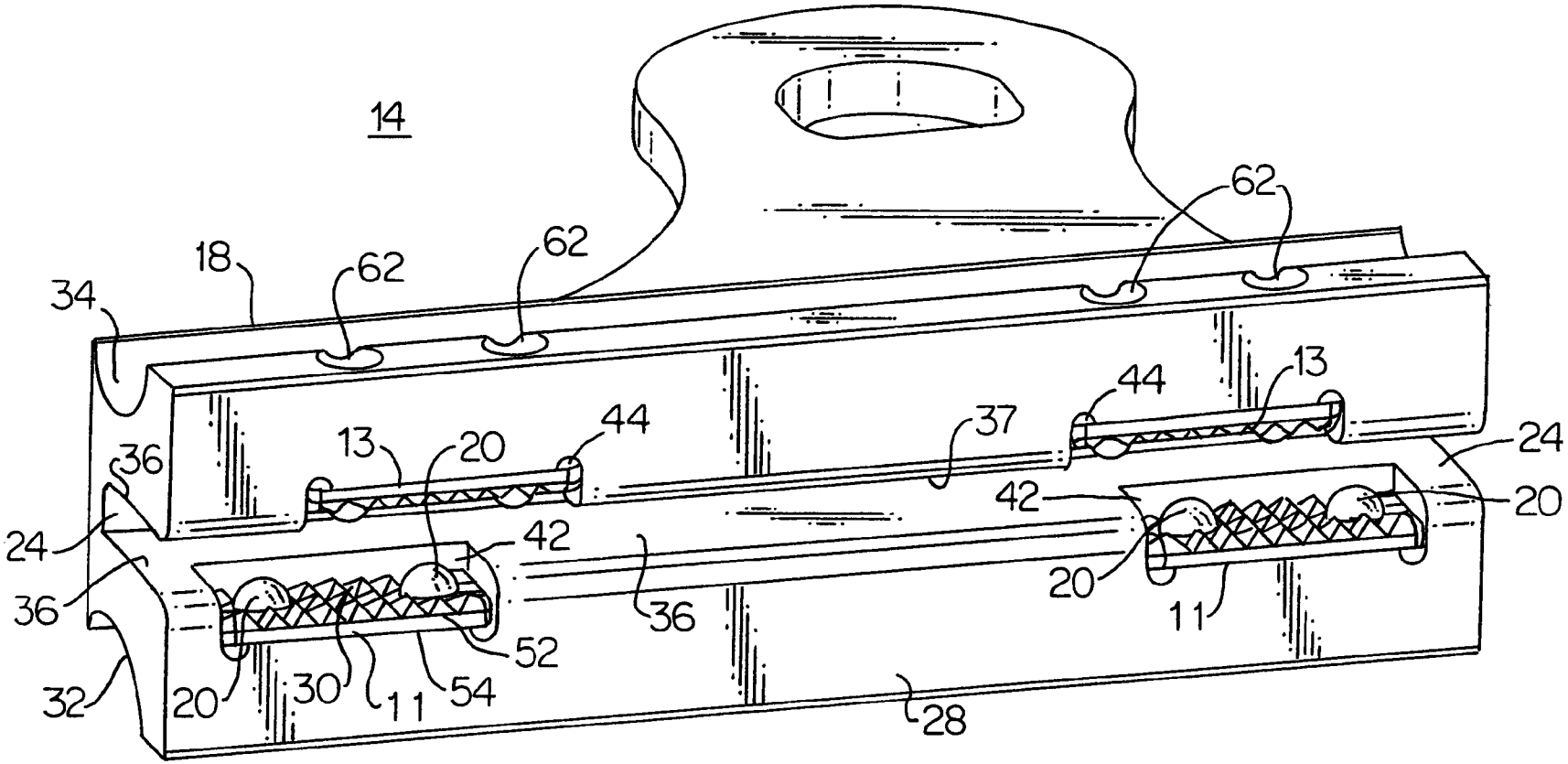
FIG. 3C shows the mounting assembly of the present invention in which a plurality of clamping pads are shown for offset engagement of opposite sides of the seam.

Turning now to FIGS. 3–5, the mounting block 18 has a groove 24 formed therein for receiving the seam 12. In the preferred embodiment, the mounting block 18 comprises a top surface 26, a bottom surface 28, a first sidewall 32 and a second sidewall 34. The groove 24 is preferably located in the bottom surface 28 thereof. This groove 24 is used to receive the roof seam 12. The groove 24 preferably defines a pair of parallel walls 36, 37. In the preferred embodiment, as shown in FIGS. 3C and 5, the groove 24 has at least one notched region formed along at least a portion of the length of at least one of the parallel walls 36, 37. The mounting block 18 preferably includes at least one bore 62 extending through the mounting block 18 between the first sidewall 32 and into the notched region 40. More than one bore 62 can be included. Each bore 62 receives the actuation member 22 which is drivable into the bore 62. The actuation member will be described in detail below.

As shown in FIG. 3A, at least one clamping pad 11 is positioned adjacent the groove 24. The clamping pad 11 is preferably constructed of any rigid material, such as a light-weight reinforced plastic or metal. As illustrated in FIGS. 6A–16D, the clamping pad 11 includes a first side 52 having at least one primary contact surface 20 outwardly protruding a first distance from the first side 52. As illustrated in FIGS. 6A–16D, the clamping pad 11 also includes at least one secondary non-spherical contact surface 30 protruding a second distance from the first side 52. In the preferred embodiment of the clamping pad 11, the second distance is less than the first distance thereby making the primary contact surface 20 the first surface to engage the seam upon actuation of the pad.

The primary contact surface 20 can have any known geometrical shape. FIGS. 6C, 8C, 10C, and 13C illustrate a few possible cross-sections. In addition, the primary contact surface 20 could have a dome-shaped cross-section (as shown in FIGS. 6A–6D), a polygonal shaped cross-section, a raised elliptical shaped cross-section, a parabolic shaped cross-section (as shown in FIGS. 13A–13D), a truncated cone shaped cross-section or any combination thereof. The only requirement is that the radius of curvature of the primary contact surface 20 should not cause tearing of the roof seam 12 upon engagement therewith. For example, as shown in FIGS. 13A–13D, the primary contact surface 20 could have a dome-like elliptical shape extending substantially along the length of the clamping pad 11, or as shown in FIGS. 6C, 7C, 9C, 11C, 12C, 14C, 15C and 16C, a hemispherical shape extending over a portion of the pad.

Although only one primary contact surface is necessary, depending upon the embodiment, the first side 52 of the clamping pad 11 can optionally have a plurality of the primary contact surfaces 20. Although not shown, the primary contact surfaces 20 could each have different geometrical shapes. To provide added stability and holding power, in preferred embodiments, each of those primary contact surfaces 20 could protrude outwardly at different distances from the first side 52.

The secondary contact surface 30 extends substantially along the length of the clamping pad 11 to thereby maximize the area of the contact surface engaging the seam 12. The secondary contact surface 30 can also have any known geometrical shape. For instance, in one particular embodiment, as shown in FIGS. 6A, 7A, 12A, 15A and 16A the secondary non-spherical contact surface 30 comprises plurality of serrated rows. Depending upon the embodiment, as shown in FIGS. 6B, 7B, 12B and 16B, the clamping pad 11 can have a plurality of the secondary contact surfaces, with each of the secondary contact surfaces having either the same or different geometrical shapes. Moreover, secondary contact surfaces may also protrude outwardly at different distances from the first side 52, so long as the different distances do not exceed the first distance mentioned above.

Preferably, as shown in FIGS. 6C, 7C, 8C, 9C, 10C, 11C, 12C, 13C, 14C, 16C, the clamping pad 11 includes a second side 54 having at least one protrusion 58 for engagement with a first end 56 of the actuation member 22. As shown in FIG. 3A, prior to actuation of the clamping pad 11, this second side 54 is initially received within the first notched region 42 of the groove 24. As one skilled in the art would recognize, the attachment mechanism according to the present invention will secure the mounting block to the roof seam when only one clamping pad is employed.

However, as noted earlier, for even more holding force, a plurality of clamping pads 11 may also be utilized. As illustrated in FIGS. 3–5, these clamping pads 11 are preferably located on opposite sides of the groove 24. These clamping pads 11 are preferably, but not necessarily, offset from one another such that the respective primary contact surfaces 20 of each pad 11 alternately engage the seam 12. When the later arrangement is utilized, a superior holding force is realized.

Figure 18A:
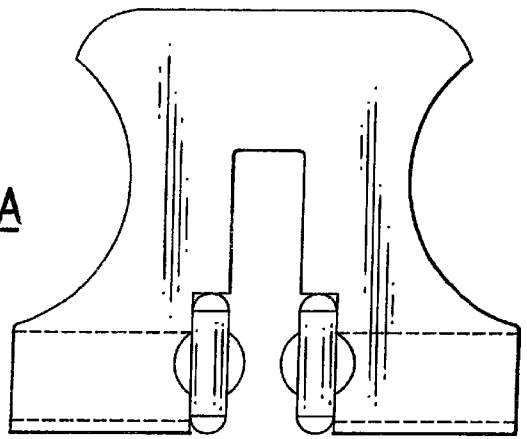
FIG. 18A shows a front end view of an attachment mechanism in which the clamping pads extend substantially along the entire length of the groove.
Figure 16A:
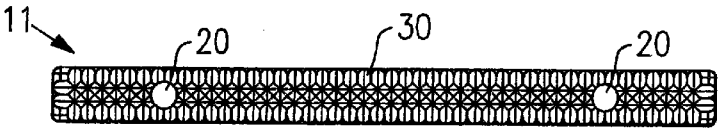
Figure 16C:
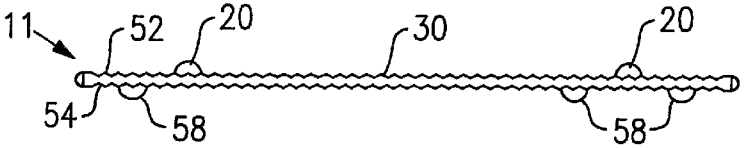
Figure 17:
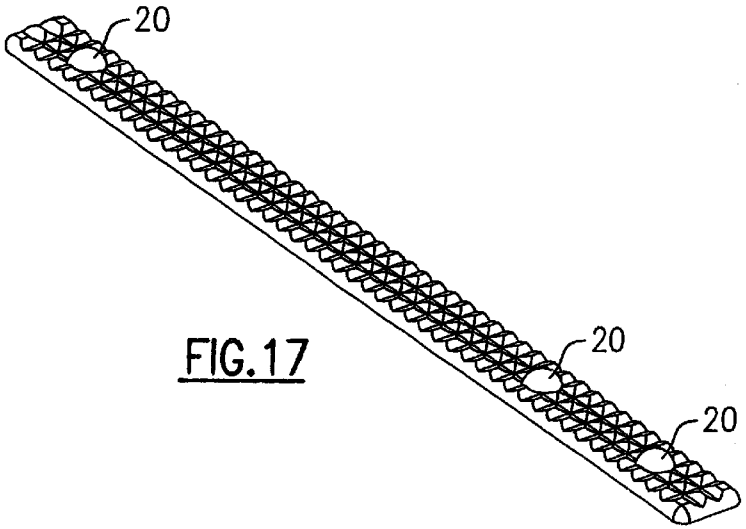
FIG. 17 shows a clamping pad having a plurality of primary contact surfaces.
Figure 18B:
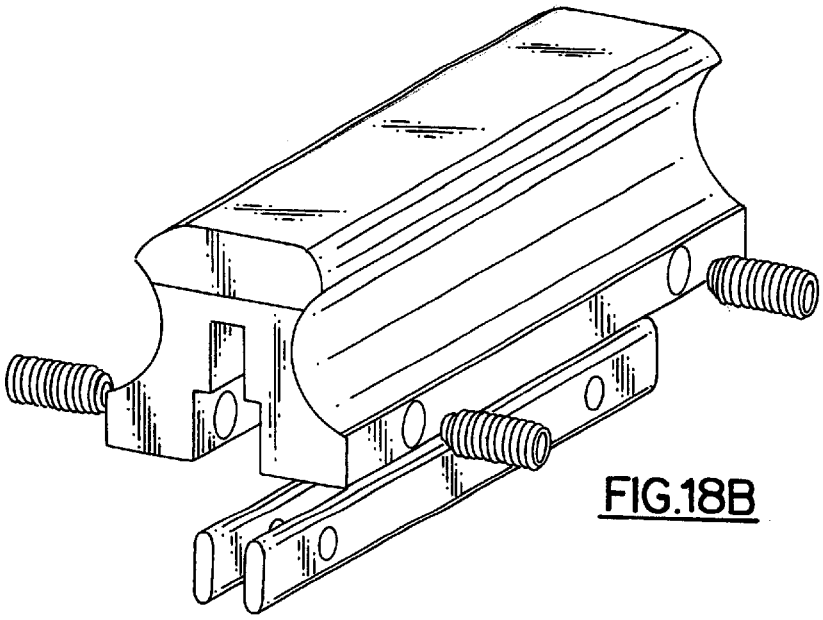
FIG. 18B shows a perspective view of an alternative embodiment of the attachment mechanism in which the clamping pads extend substantially along the entire length of the groove.

It should also be recognized that the clamping pads 11 may cover a portion of the parallel walls 36, 37 which define the groove 24. Alternatively, the clamping pads 11 may extend along the entire length of the groove 24, as shown in FIGS. 18A and 18B. This provides even better attachment since a greater area of the clamping pad is in contact with the seam 12. In addition, by making the clamping pad extend along the entire length of the groove 24, it is also possible to provide a greater number of primary contact surfaces, and to therefore provide greater contact area between the seam and the pad.

To better illustrate the method of operation of the clamping pad(s), the method by which an individual attachment mechanism operates will now be described in detail. This will then be followed by a description of the method of operation of a mounting assembly utilizing multiple clamping pads.

As illustrated in FIGS. 3A and 3B, the actuation member 22 (shown by itself in FIG. 3C) is actuated by inwardly rotating the actuation member (not shown) to cause the clamping pad 11 to move toward the seam 12. This causes at least the primary contact surface 20 to engage the seam 12. This engagement prevents relative movement between the mounting block 18 and the seam 12. Thus, by driving the actuation member into the bore 62, at least a portion of the primary contact surface 20 is caused to engage a portion of the seam. The primary contact surface 20 should preferably cause the roof seam to dimple, and for maximum holding power should mechanically distort the linearity of the roof seam 12. The secondary contact surface 30 may also be brought into contact with the seam if additional holding force is necessary. Preferably, the actuation member moves the clamping pad 11 in a direction substantially perpendicular to a longitudinal extension direction of the groove 24.

Once again, if more holding force is required, then it may be necessary to utilize multiple clamping pads. The method of operation of a mounting assembly utilizing multiple clamping pads will now be described in detail with reference to FIGS. 3–5. As shown in FIGS. 3C–5, the groove 24 has multiple notched regions 42, 44 formed along at least a portion of the length of the parallel walls 36, 37 which define the groove 24. Each of these notched regions 44, 46 accommodates a clamping pad therein. These notched regions are preferably offset from one another for reasons discussed below. The mounting block 18 also has a plurality of bores 62 extending through the mounting block 18 between the first sidewall 32 and into the first notched region 42. Each bore receives therein a first actuation member. This actuation member is drivable into the first bore 62. The second notched region 44 is formed along at least a portion of the length of the other parallel wall 37. As noted above and shown in FIGS. 3C, 4B and 5, this second notched region 44 is preferably offset from the first notched region 42. The mounting block 18 also has at least one second bore 62 extending through the mounting block 18 between the second sidewall 34 and into the second notched region 44. Each second bore 62 receives therein a second actuation member being drivable into the second bore 62.

As shown in FIG. 3C, a first clamping pad 11 is received within the first notched region 42 of the groove 24. This first clamping pad 11 includes a first side 52 and a second side 54. The first side 52 has at least one primary contact surface 20 outwardly protruding a first distance from the first side 52. In addition, as shown in FIG. 4A, at least one secondary non-spherical contact surface 30 protrudes a second distance from the first side 52. Preferably, the second side 54 has at least one protrusion 58 for engagement with a first end 56 of the first actuation member. It is this second side 54 that is initially received within the first notched region 42 of the groove 24.

As shown in FIG. 4A, at least one second clamping pad 13 is received within the second notched region 44 on the other sidewall 37 of the groove 24. Although the second clamping pad 13 is preferably identical to the first, it does not necessarily have to be identical to the first clamping pad 11. The second clamping pad 13 includes a side 66 and an engagement side 64, analogers to the first side 52 and second side 54, respectively. The side 66 has at least one initial contact surface 60 outwardly protruding a first distance from the side 66. Moreover, as shown in FIG. 4A, at least one auxiliary non-spherical contact surface 70 protrudes a second distance from the side 66. An engagement side 64 has at least one inwardly extending member for engagement with a first end 56 of the second actuation member 22A.

Figure 19A:
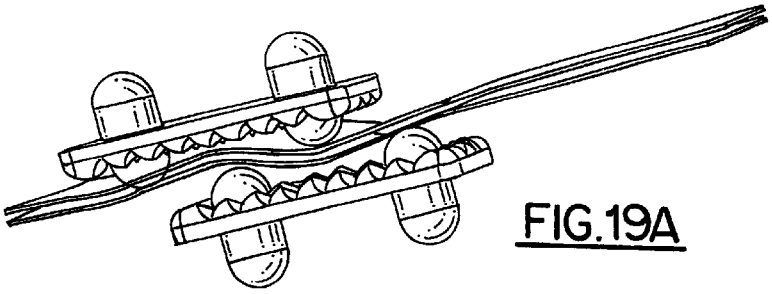
FIG. 19A shows a top view of how the clamping pads mechanically distort the linearity of the scam.
Figure 19B:
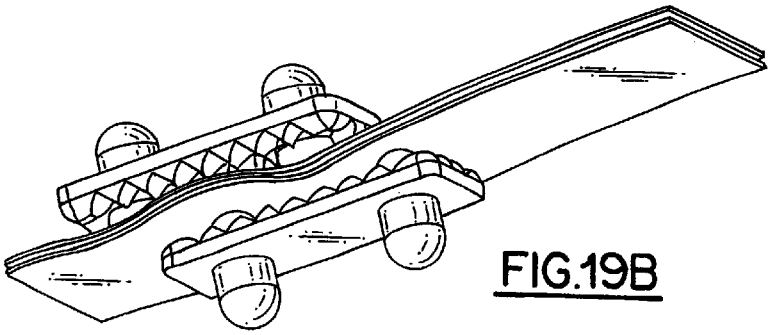
FIG. 19B shows a bottom view of how the clamping pads mechanically distort the linearity of the seam.
Figure 18C:
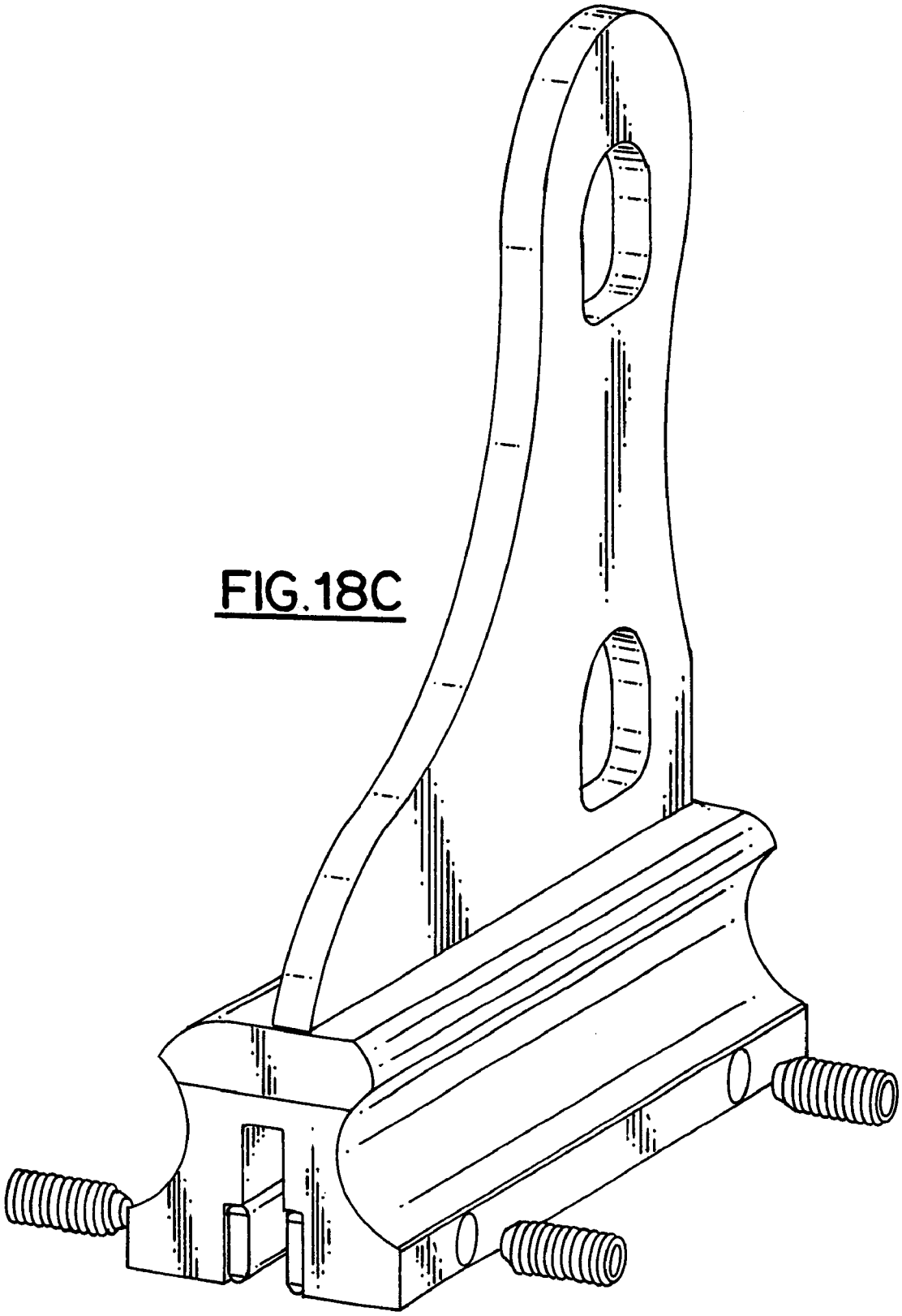
FIG. 18C shows the attachment mechanism shown in FIG. 18B with clamping pads extending substantially along the entire length of the groove in place.

In a preferred embodiment, the side 66 preferably comprises a plurality of initial contact surfaces 60, and the first side 52 comprises a plurality of primary contact surfaces 20 disposed between the initial contact surfaces 60 in an alternatively manner. As mentioned above, when a plurality of clamping pads arc utilized, the first and second clamping pads 13 should preferably be offset from each other. As shown in FIGS. 19A and 19B, by offsetting the opposed clamping pads 11 in this manner, the primary contact surfaces 20 and initial contact surfaces 60 interlock with each other in an alternating manner to securely grasp the seam 12, thereby providing more holding force as the clamp pads engage the seam 12. In other words, the initial contact surfaces 60 and primary contact surfaces 20 will be alternatively disposed between each other to lock the mounting block 18 in place along the seam 12.

The actuation members 22 are actuated by driving the first and second actuation members 22 into the first and second bores 62. Driving the first and second actuation members 22 into the first and second bores 62 causes the respective first ends 56 of the first and second actuation members 22 to engage the protrusions 58 of the inwardly extending member, respectively. This causes a portion of the first side 52 and a portion of the second side 54 to engage a first of the seam 12 and a second portion of the seam 12, respectively. The first and second portions can include a common, overlapping portion of the seam. Conversely, the first and second portions may not overlap at all. Either way, relative movement between the mounting block 18 and the seam 12 is prevented.

As can be seen from the above disclosure, a clamping pad 11 having multiple contact areas has been described. Each contact area serves to deform a roof seam 12 thereby increasing the effective contact area between the roof seam 12 and clamping pad 11. Increasing the effective contact area between the roof seam 12 and the clamping pad 11 significantly increases the sliding resistance of the clamping pad 11 along the seam 12. The use of multiple contact surfaces is also advantageous since it allows the holding force to be distributed more evenly over a greater area of the seam 12 (and over a greater number of contact points). By distributing the contact surfaces in this manner, a greater net holding force can be applied without violating or otherwise destroying the integrity of the surface finish or the seam 12 itself (i.e., crack or cut the surface). Using multiple contact surfaces also results in improved stability since a plurality of contact surfaces provides increased sliding resistance between the seam 12 and the attachment mechanism. Thus, in order to detach the clamping pad 11 from the seam 12, the snowload must simultaneously exceed the friction force between the seam 12 and each of the contact surfaces. This results in a greater net holding force.

While the present invention has been particularly shown and described with reference to the preferred mode as illustrated in the drawings, it will be understood by one skilled in the art that various changes in detail may be effected therein without departing from the spirit and scope of the invention as defined by the claims.

I claim:

1. A mounting assembly for puncture-free attachment of a snow guard system to a roof seam, comprising:

a mounting block having a groove formed therein for receiving the seam;

at least one clamping member positioned adjacent said groove, said clamping member comprising a first side having at least one primary contact surface outwardly protruding a first distance from said first side, and at least one secondary contact surface protruding a second distance from said first side; and an actuation member for moving said clamping member to cause at least said primary contact surface to engage the seam thereby preventing relative movement between the mounting block and the seam.

2. The mounting assembly of claim 1, wherein said groove is defined by a pair of parallel walls, and said groove has at least one notched region formed along at least a portion of the length of at least one of said parallel walls.

3. The mounting assembly of claim 2, wherein said mounting block has at least one bore extending through said mounting block between said first sidewall and into said notched region, and each bore receives an actuation member drivable into said bore.

4. The mounting assembly of claim 2, wherein said clamping member further comprises a second side having at least one protrusion for engagement with a first end of said actuation member, and wherein said second side is initially received within said notched region of said groove.

5. The mounting assembly of claim 1, wherein said second distance is less than said first distance.

6. The mounting assembly of claim 1, wherein said secondary contact surface has a geometrical shape extending substantially along the length of said clamping member.

7. The mounting assembly of claim 1, wherein said primary contact surface has a dome-like elliptical shape extending substantially along the length of said clamping member.

8. The mounting assembly of claim 7, wherein said primary contact surface has a hemispherical shape.

9. The mounting assembly of claim 1, wherein said first side has a plurality of said primary contact surfaces.

10. The mounting assembly of claim 1, wherein said secondary contact surface comprises a plurality of serrated rows.

11. The mounting assembly of claim 1, wherein said clamping member is constructed of a rigid material.

12. The mounting assembly of claim 1, wherein said primary contact surface has a cross-sectional shape selected form the group consisting of a dome-shaped cross-section, a polygonal shaped cross-section, an elliptical shaped cross-section, a parabolic shaped cross-section, and a truncated cone shaped cross-section.

13. A mounting assembly for puncture-free attachment of a snow guard system to a roof seam, comprising:

a mounting block having a groove formed therein for receiving the seam;

at least one clamping member positioned adjacent said groove, said clamping member comprising a first side having a first area, said first side being in opposing relationship with the seam; and an actuation member for moving said clamping member toward the seam, said actuation member having a cross-sectional area that is substantially less than said first area of said clamping member.

* * * * *